US010335662B2

(12) United States Patent
Vilhelmsen

(10) Patent No.: US 10,335,662 B2
(45) Date of Patent: Jul. 2, 2019

(54) EXERCISE BALANCE AND FLEXIBILITY METHOD

(71) Applicant: Kurt Vilhelmsen, Buckley, WA (US)

(72) Inventor: Kurt Vilhelmsen, Buckley, WA (US)

( * ) Notice: Subject to any disclaimer, the term of this patent is extended or adjusted under 35 U.S.C. 154(b) by 0 days.

(21) Appl. No.: 15/626,922

(22) Filed: Jun. 19, 2017

(65) Prior Publication Data

US 2018/0126243 A1 May 10, 2018

Related U.S. Application Data

(63) Continuation-in-part of application No. 14/970,954, filed on Dec. 16, 2015, now Pat. No. 9,682,303.

(60) Provisional application No. 62/092,661, filed on Dec. 16, 2014.

(51) Int. Cl.

| | |
|---|---|
| ***A63B 23/04*** | (2006.01) |
| ***A63B 69/36*** | (2006.01) |
| ***A63B 69/00*** | (2006.01) |
| ***A63B 67/10*** | (2006.01) |

(52) U.S. Cl.

CPC ..... *A63B 69/3608* (2013.01); *A63B 69/0059* (2013.01); *A63B 23/04* (2013.01); *A63B 67/10* (2013.01); *A63B 2023/0411* (2013.01); *A63B 2225/093* (2013.01)

(58) Field of Classification Search

CPC ..... A63B 69/3608; A63B 69/0059; A63B 69/3673; A63B 2023/0411; A63B 2023/0441; A63B 2023/0447

USPC ..... 473/208

See application file for complete search history.

(56) References Cited

U.S. PATENT DOCUMENTS

| | | | | | |
|---|---|---|---|---|---|
| 1,459,705 | A * | 6/1923 | Bullock | A63B 69/3608 | 473/208 |
| 2,461,826 | A * | 2/1949 | Krautter | A63B 69/3608 | 124/44.6 |
| 3,545,764 | A * | 12/1970 | Broderick | A63B 69/3608 | 473/210 |
| 3,729,200 | A * | 4/1973 | Hines | A63B 69/3608 | 2/209.13 |
| 3,860,246 | A * | 1/1975 | Fish | A63B 69/3608 | 473/210 |
| 4,371,162 | A * | 2/1983 | Hartzell | A63B 21/04 | 482/123 |
| 4,790,539 | A * | 12/1988 | Clark | A63B 69/3608 | 2/425 |
| 5,813,954 | A * | 9/1998 | Wilkinson | A63B 21/0004 | 482/124 |

(Continued)

*Primary Examiner* — Nyca T Nguyen

(74) *Attorney, Agent, or Firm* — Dean A. Craine, P.S.

(57) ABSTRACT

A method for performing balancing and squatting exercises that uses a kit that includes a clip attached to the brim on a hat or visor worn by the exerciser. Attached to the clip is a string that attaches to a weight. When the clip attaches to the brim the length of the string is adjusted so the weight hangs just above the ground when standing and when lowering to a squat position while standing on one leg or two legs. During use, exerciser stands upright with his arms extended outward and then bends his knees to a squatting position while keep the back straight. The exerciser identifies a spot on the ground and squats to place the weight over the spot. As the exerciser becomes more flexible, the length of the string is shortened. The kit may also include an optional elongated stick that extends over the exerciser's two shoulders.

2 Claims, 5 Drawing Sheets

(56) References Cited

U.S. PATENT DOCUMENTS

| | | | | |
|---|---|---|---|---|
| 6,991,556 | B2 * | 1/2006 | LaTerra | A63B 69/3608 2/209.13 |
| 2003/0045368 | A1 * | 3/2003 | Farmer | A63B 69/3608 473/268 |

* cited by examiner

EXERCISE BALANCE AND FLEXIBILITY METHOD

This is a continuation in part utility patent application is based upon and claims the filing date benefit of U.S. utility patent application (application Ser. No. 14/970,954) filed on Dec. 16, 2015 which is based upon and claims the filing date benefit of U.S. Provisional patent application (Application No. 62/092,661) filed on Dec. 16, 2014.

Notice is given that this patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to exercising tools for individuals to improve balance and flexibility.

2. Description of the Related Art

Individuals with hip and knee injuries are required to perform rehabilitation exercises to increase muscle strength and joint flexibility. It is difficult for individuals and health-care workers to accurately measure changes in an individual's muscle strength and flexibility.

According to American Council on Exercise-Certified Fitness Professionals, squats are one of the most effective exercises for toning the lower body. The primary muscles used when squatting are quadriceps, hamstrings and gluteus maximus. There are also several secondary muscles used when squatting—soleus, gastrocnemius, and erector spinae.

When performing squats, it is important that the exerciser uses proper form. The back should be straight at all times and the user's knees should be aligned directly over the feet with at the lowest point. The ability to perform a squat depends on the fitness level of the exerciser.

What is needed is a method of exercising that enables an individual to perform squats to develop muscles joint flexibility and balance

SUMMARY OF THE INVENTION

The above cited objects are satisfied by the method disclosed that uses a kit initially described as a golf swing elevation and balance kit that helps a golfer detect an improper stance, insufficient flexibility, improper weight shifting, improper rotation of the waist and shoulders, and improper holding of the neck and head in a downward tilted orientation during a golf swing.

The golf swing kit includes a flexible elongated stick designed to be positioned perpendicular to the golfer's spine and longitudinally aligned with and extended over the golfer's shoulders and behind the golfer's neck. The elongated stick is sufficiently long so the golfer may extend his or her forearms upward and outward partially over the elongated tick and hold the elongated stick on the shoulders as they are rotated. The golfer then twists his or her waist and upper torso and shoulders in a clockwise and counter-clockwise direction (for a right handed golfer) so the opposite ends of the elongated stick and opposite shoulders move forward and rearward. The golfer gradually twists the waist and rotates the upper torso and repeatedly swings the elongated stick back and until the clavicle on each shoulder and the ends of the elongated stick touch or pass over the golfer's midline axis. When the ends of the elongated stick cross the golfer's midline axis, the golfer's upper torso is considered sufficiently flexible to properly swing a golf club.

The kit also includes a golf ball elevational tool that includes a main clip designed to attach to the front edge of the brim on a hat or visor worn by a golfer. Attached to the clip is a lightweight string that attaches to a regulation size golf ball. During use, the golfer attaches the clip to the brim of the hat or visor and adjusts the length of the string so when the golfer is in a stance for hitting a golf ball on the ground or tee, and the golf ball hangs freely from the brim and positioned ¼ to ½ inch above the ground. The golfer then places the elongated stick horizontally over both shoulders and tilts his neck and head slightly downward so his or her chin and nose point downward and his or her eyes looking at the ball. The golfer then rotates his or her spine causing the shoulders to swing forward and rearward trying not to lift or swing the ball forward or backward or from left to right.

Investigations by the inventor have also discovered that kit may also be used as a method for developing muscles, joint flexibility and balance.

The method includes the steps of selecting the kit, attaching the clip to the front edge of the brim on a hat or visor worn by an exerciser. The clip is attached to a string that is attached to a weight, such as a golf ball. The length of the string is adjusted so the golf ball hangs freely just above the ground when standing and then lowered to the ground when performing a squat.

During use, the exerciser stands upright with his arms either folding inward, extended laterally, or extending downward against the side of the body or extended forward. [.] The exerciser then bends his knees to a squatting position while keeping the back straight without bending the waist. The user then identifies a spot on the ground and lowers himself to a position in which the so that golf ball is positioned directly above or touches the spot. As the exerciser becomes more flexible, the length of the string is shortened. The length of the sting becomes an indicator of the exerciser's muscle tone, flexibility and balance.

The kit may also include an optional elongated stick used in the golf kit that extends longitudinally over the exerciser's two shoulders as the exerciser squats. The user may also twist from side to side as he squats.

In summary, the method comprises the following steps:

a. selecting a kit that includes a main clip designed to attach to the front edge of a forward extending brim on a hat or visor worn by the golfer, a length adjustable lightweight string attached at one end to the main clip and a weight attached to the end of the string opposite the end attached to the main clip;

b. attaching the clip to the brim of the golfer's hand or visor;

c. adjusting the length of the string so that the weight is positioned just above the ground when squatting to the lowest desired squatting location;

d. identifying a location on the ground directly below the clip;

e. performing a squat to the lowest possible squatting location so that the weight remains vertically aligned with the spot and the exerciser maintains his or her balance; and f. repeating step e.

DESCRIPTION OF THE PREFERRED EMBODIMENT(S)

Referring to the FIGS. 1-4, there is shown a golf swing elevation and balance kit 10 that helps a golfer 80 detect improper stance, improper balance, insufficient flexibility or improper rotation of the waist and improper alignment of the golfer's head 84 and neck during a golf swing.

Figure 1:
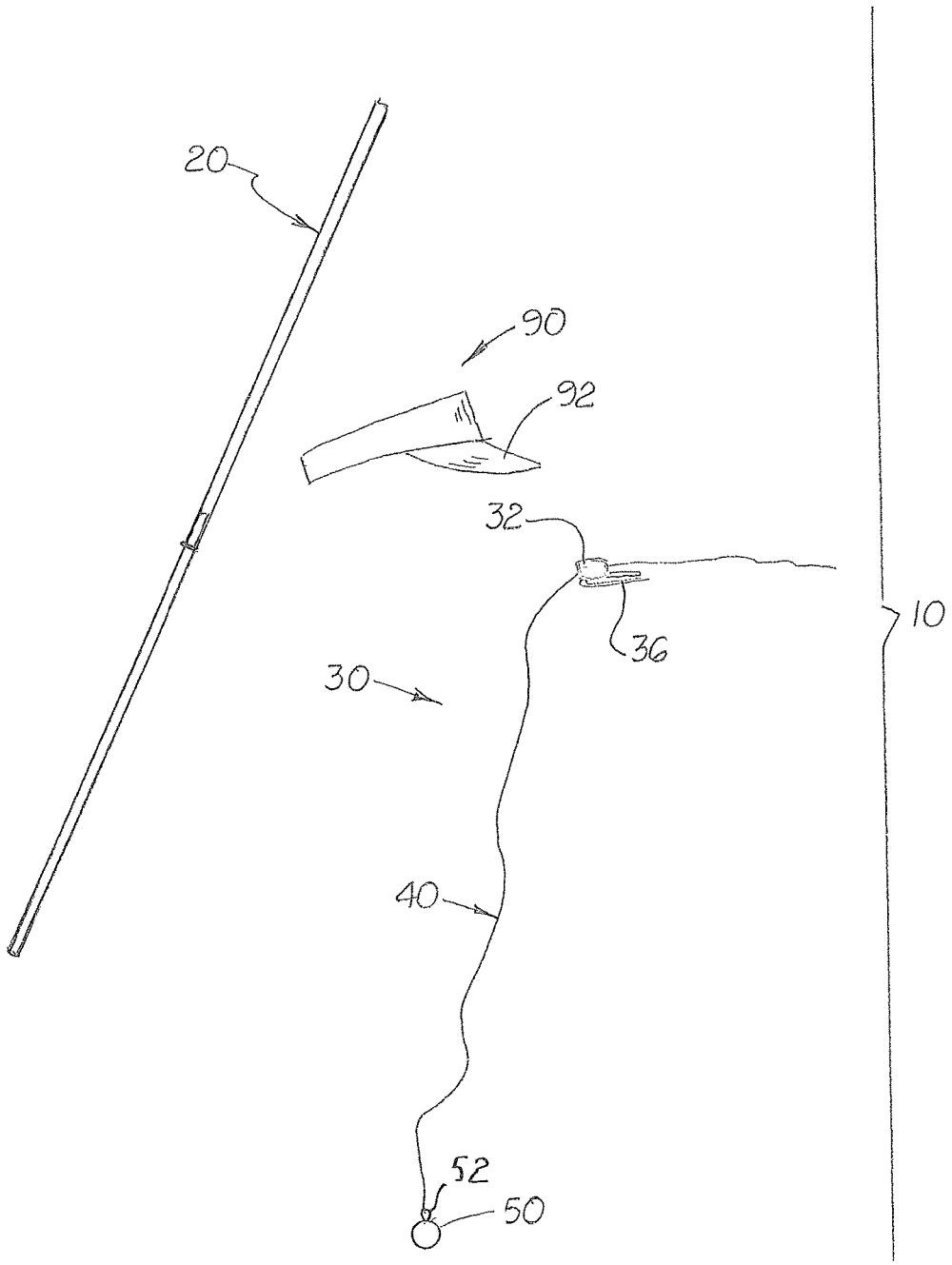
FIG. 1 is an illustration of the golf swing elevation and balance.
Figure 2:
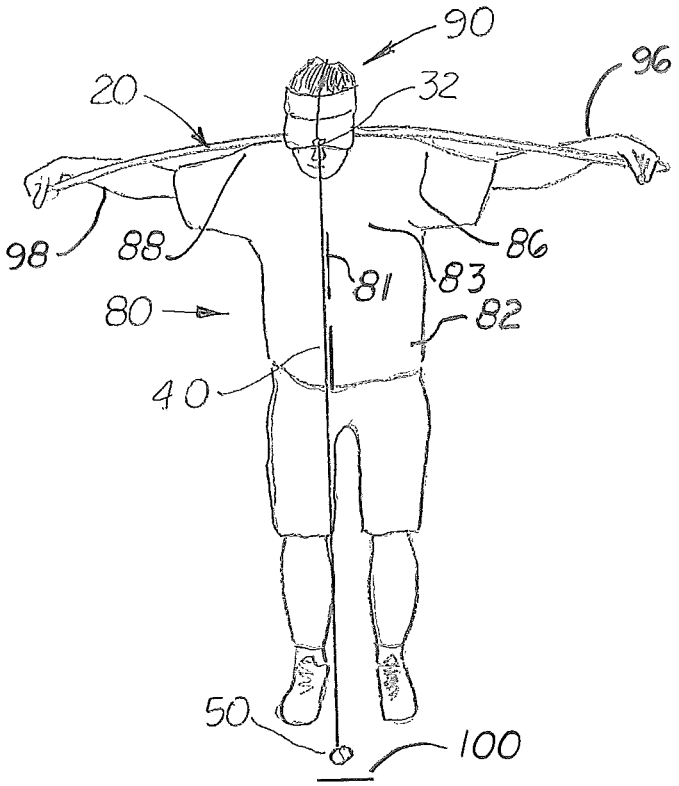
FIG. 2 is an illustration of a golfer with the elongated stick extended over the golfer's shoulder and the golf ball elevated tool attached to the brim of the golfer's visor
Figure 3:
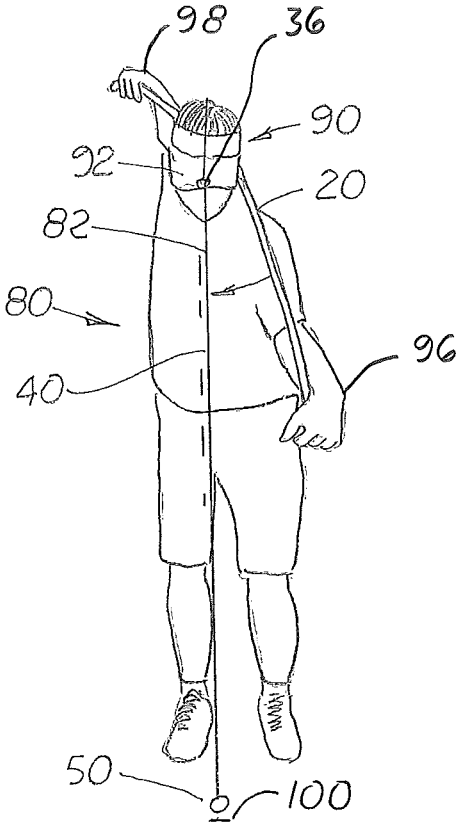
FIG. 3 is an illustration of a golfer as shown in FIG. 2 rotating his waist and shoulders while tilting the neck and head downward and looking downward over the golf ball.
Figure 4:
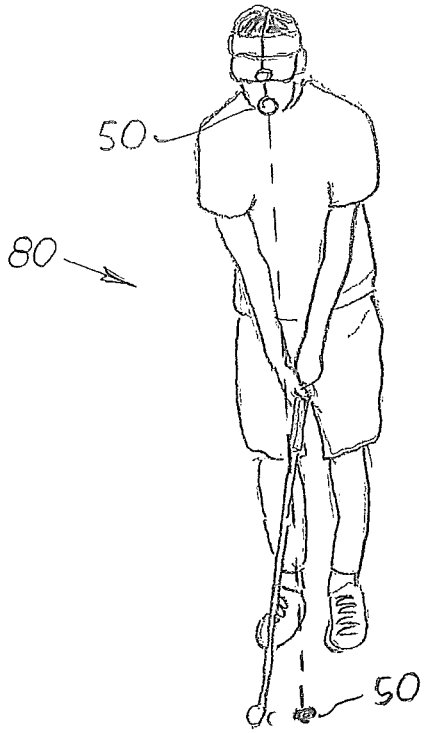
FIG. 4 is an illustration of the golfer in a stance to hit a golf ball.

The kit 10 includes a flexible elongated stick 20 designed to be positioned horizontally over the shoulders 86, 88 and behind the golfer's 80 neck. The elongated stick 20 is evenly aligned over the shoulders 86, 88 and sufficient in length to allow the golfer 80 to extends both arms 90, 92 outward and extend both forearms around the opposite ends of the elongated stick 20 as shown in FIG. 2. The golfer 80 repeatedly rotates the elongated stick 20 90 degrees in opposite directions causing the waist 82 and upper torso 83 to also rotate so the opposite shoulders 86, 88 and opposite ends of the stick 20 reach or extend over the golfer's midline axis 81. Initially, the golfer 80 may not be able to rotate the elongated stick 90 degrees in both directions. The golfer 80 repeatedly rotates his and her opposite shoulders 86, 88 forward and rearward until the waist 82, the upper torso 83 and shoulders 86, 88 are stretched.

The kit 10 also includes a golf ball elevational tool 30 that includes a main body 32 attached to a clip 36 designed to attach to the front edge of a brim 92 on a visor or hat 90 worn by the golfer 80. Attached to the clip 36 is a lightweight string 40 that attaches to a regulation size golf ball 50. During use, the golfer 80 attaches the clip 36 to the brim 92 of his or her visor or hat 90 and adjusts the length of the string 40 so the golf ball 50 is positioned just above the ground 100. In the preferred embodiment the string 40 is approximately 84 inches in length. Attached to the golf ball 50 is an eyelet 52 that is used as a connection point and as a structure for winding up excessive string 40 to shorten the string 40. The golfer 80 then places the elongated stick 20 over the opposite shoulders 86, 88, extends his or her arms 90, 92 under the elongated stick 20 and tilts the neck and head 84 slightly downward to look at the golf ball 50. The golfer 80 then rotates his or her shoulders 86, 88 forward and rearward and the elongated stick 20 without lifting the golf ball 50 or causing the golf ball 50 to swing forward or backward or from side-to-side.

If the golf ball 50 swings excessively forward, rearward or side to side as the shoulders are rotated, such movement may indicate the golfer's stance is improper, that the waist 82 or upper torso 83 may be too rigid or inflexible, that the rotation of the waist 82 is not smooth and continuous, or that the golfer's balance was improper. The golfer 80 continues to rotate the elongated stick 20 and the shoulders 86, 88 and monitor movement of the golf ball 50 until movement of the golf ball is minimized (e.g. no more that 1 inch). The golfer 80 practices the exercises for several days until movement of the golf ball 50 is minimal after the first rotation.

In one embodiment, the elongated stick 20 is a lightweight plastic pipe made of PVC approximately 1 inch thick and 36 to 60 inches in length. In one embodiment, the elongated stick 20 is a fixed length. In another embodiment, the elongated stick 20 is a telescopic structure that collapses into a short tube approximately 24 inches in length and extends 48 inches in length. In another embodiment, the elongated stick 20 is eliminated and golf club is used in its place.

A method for monitoring and developing proper stance, balance, waist and shoulder flexibility and neck position when performing a golf swing, comprising the following steps:

a. selecting a flexible, elongated stick or golf club;

b. selecting a golf ball elevational tool that includes a main clip designed to attach to the front edge of a forward extending brim on a hat or visor worn by the golfer, said golf ball elevational tool also includes a length adjustable lightweight string attached at one end to said clip and a regulation size golf ball attached to the end of said string opposite the end attached to the clip;

c. attaching the clip to the brim of the golfer's hand or visor;

d. adjusting the length of said string so the golf ball is positioned just above the ground when the golfer's head and neck are slightly tilted downward when executing a golf swing;

e. placing the elongated stick or golf club over his or her the shoulders and turning the head and neck downward towards the ball; and, f. rotating the elongated stick or golf club and the shoulders until the ends of the stick reach the golfer's front mid-line axis without lifting the ball or causing the ball to swing forward, backward, left or to the right while watching the golf ball.

The above kit 10 may also be used as an exercise device to monitor an exerciser's balance and flexible. The method includes the steps of attaching the clip 36 to the front edge of the brim on a hat or visor worn by the exerciser. Attached to the clip 36 is the length adjustable string 40 that attaches to a golf ball 50. The length of the string 40 is adjusted so the golf ball 50 hangs freely just above the ground 100 when standing and when lowering to a squat position while standing on one leg or two legs as shown in FIG. 5.

Figure 5:
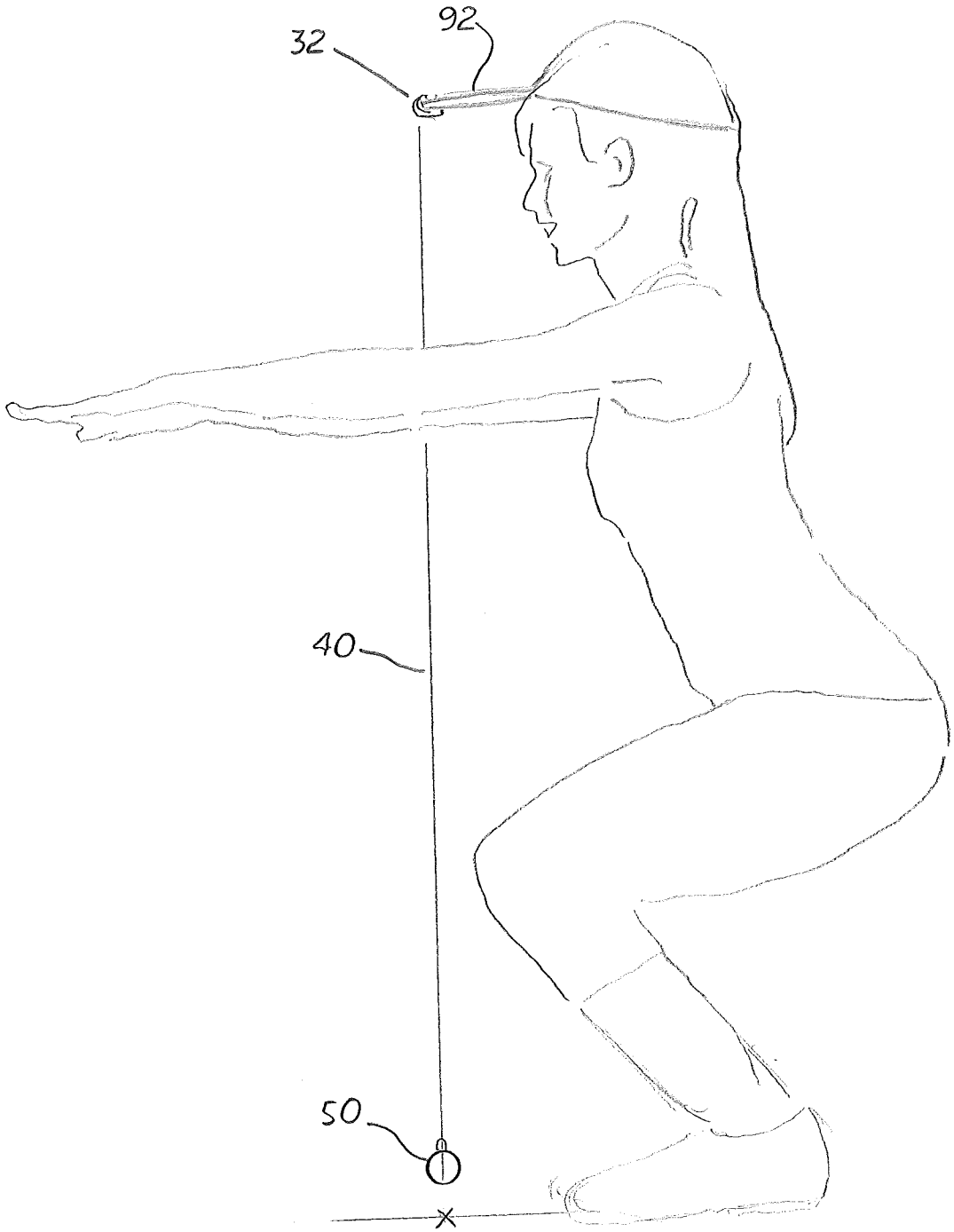
FIG. 5 is an illustration of an exerciser performing a squat using the kit.

During use, exerciser stands upright with his arms either folding inward, extended downward against the side of the body, extended outward, or held forward as shown in FIG. 5. The exerciser then bends her knees to a squatting position while keeping the back straight without bending the waist. The exerciser then identifies a point on the ground and lowers herself so that the golf ball is positioned directly above or on the spot. As the exerciser becomes more flexible, the length of the string 40 is shortened.

It should be understood the golf ball 50 may be replace with any object that provides sufficient weight approximately equivalent to a golf ball and will not injure the exerciser when user.

The kit 10 may also include an optional elongated stick 20 that extends longitudinally over the exerciser's two shoulders as the exerciser squats. The exerciser may twist from side to side as she squats.

The exercise method, comprises the following steps:

selecting a golf ball elevational tool kit 10 that includes a main clip 36 designed to attach to the front edge of a forward extending brim on a hat or visor worn by an exerciser, the kit includes a length adjustable lightweight string 40 attached at one end to the clip 36 and a weight 50 attached to the end of the string 40 opposite the end attached to the main clip 36;

c. attaching the main clip 36 to the brim 92 of the exerciser's hat or visor;

d. adjusting the length of said string 40 so the weight 50 is positioned just above the ground when squatting to the lowest desired squatting location;

e. identifying a spot on the ground directly below the main clip 36;

f. performing the squat to the lowest squatting location so that the weight 50 hits or is positioned directly above the spot on the ground; and g. repeating step f.

In compliance with the statute, the invention described has been described in language more or less specific on structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A method for an exerciser to perform different balancing squat exercise, comprising the following steps:

a. selecting a swing elevation and balance kit that includes a main clip designed to attach to the front edge of a brim on a visor or hat at a location aligned with the exerciser's front midline axis, a length adjustable string attached at one end to said main clip, and a weight attached at an end of said string opposite said end attached to said main clip;

b. attaching said main clip to said brim so that the string is aligned with said exerciser's front midline axis;

c. selecting a balancing squat exercise to perform from a standing position that requires the exerciser to keep said weight aligned with said midline axis all times;

d. adjusting the length of the string so that said weight is elevated above ground and supported by said brim on the visor or hat when standing and remains elevated above the ground and when performing said balancing squat exercise;

e. performing said balancing squat exercise and simultaneously keeping said weight aligned over said midline axis at all times; and f. repeating step (e) repeatedly.

2. The method as recited in claim 1, wherein said weight is a golf ball.

* * * * *